US007347832B2

(12) United States Patent
Jensen et al.

(10) Patent No.: US 7,347,832 B2
(45) Date of Patent: Mar. 25, 2008

(54) LIGHTWEIGHT ELECTRO-MECHANICAL CHEST COMPRESSION DEVICE

(75) Inventors: James O. Jensen, Sunnyvale, CA (US); Paul Q. Escudero, Sunnyvale, CA (US); Reynaldo J. Quintana, Redwood City, CA (US); Charles E. Swinehart, Sunnyvale, CA (US)

(73) Assignee: Zoll Circulation, Inc., Sunnyvale, CA (US)

( * ) Notice: Subject to any disclaimer, the term of this patent is extended or adjusted under 35 U.S.C. 154(b) by 512 days.

(21) Appl. No.: 10/686,549

(22) Filed: Oct. 14, 2003

(65) Prior Publication Data

US 2005/0080364 A1 Apr. 14, 2005

(51) Int. Cl.
*A61H 31/00* (2006.01)

(52) U.S. Cl. ..... 601/41; 601/DIG. 6

(58) Field of Classification Search ..... 601/1, 601/41–44, 89, 93, 97, 104–107, 134, 135, 601/143, 144
See application file for complete search history.

(56) References Cited

U.S. PATENT DOCUMENTS 3,802,638 A * 4/1974 Dragan ..... 242/586.2
4,770,164 A * 9/1988 Lach et al. ..... 601/41
5,287,846 A 2/1994 Capjon et al. ..... 601/44
5,738,637 A 4/1998 Kelly et al. ..... 601/41
6,066,106 A * 5/2000 Sherman et al. ..... 601/41
6,142,962 A * 11/2000 Mollenauer et al. ..... 601/41
2002/0088893 A1* 7/2002 Nichols ..... 242/546

FOREIGN PATENT DOCUMENTS

WO WO 03/024336 A1 * 3/2003

* cited by examiner

*Primary Examiner*—Danton DeMille
(74) *Attorney, Agent, or Firm*—Paul J. Backofen, Esq.; K. David Crockett, Esq.; Crockett & Crockett

(57) ABSTRACT

A lightweight electro-mechanical chest compression device. The device is provided with a motor, a brake, a drive spool, a control system, and a metal channel beam to brace the device and guide a compression belt. The belt is provided in a belt cartridge that attaches to the channel beam. In use, the belt is secured around the patient and to the drive spool. The motor tightens the belt by turning the drive spool. The electro-mechanical chest compression device weighs less than 30 pounds when fully assembled with its power source.

7 Claims, 5 Drawing Sheets

LIGHTWEIGHT ELECTRO-MECHANICAL CHEST COMPRESSION DEVICE

FIELD OF THE INVENTIONS

The inventions described below relate the field of cardiopulmonary resuscitation and in particular to automatic chest compression devices.

BACKGROUND OF THE INVENTIONS

Cardiopulmonary resuscitation (CPR) is a well-known and valuable method of first aid used to resuscitate people who have suffered from cardiac arrest. CPR requires repetitive chest compressions to squeeze the heart and the thoracic cavity to pump blood through the body. Artificial respiration, such as mouth-to-mouth breathing or a bag mask apparatus, is used to supply air to the lungs. When a first aid provider performs manual chest compression effectively, blood flow in the body is about 25% to 30% of normal blood flow. However, even experienced paramedics cannot maintain adequate chest compressions for more than a few minutes. Hightower, et al., *Decay In Quality Of Chest Compressions Over Time,* 26 Ann. Emerg. Med. 300 (September 1995). Thus, CPR is not often successful at sustaining or reviving the patient. Nevertheless, if chest compressions could be adequately maintained, then cardiac arrest victims could be sustained for extended periods of time. Occasional reports of extended CPR efforts (45to 90 minutes) have been reported, with the victims eventually being saved by coronary bypass surgery. See Tovar, et al., *Successful Myocardial Revascularization and Neurologic Recovery,* 22 Texas Heart J. 271 (1995).

In efforts to provide better blood flow and increase the effectiveness of bystander resuscitation efforts, various mechanical devices have been proposed for performing CPR. In one variation of such devices, a belt is placed around the patient's chest and an automatic chest compression device tightens the belt to effect chest compressions. Our own patents, Mollenauer et al., *Resuscitation device having a motor driven belt to constrict/compress the chest*, U.S. Pat. No. 6,142,962 (Nov. 7, 2000); Bystrom et al., *Resuscitation and alert system*, U.S. Pat. No. 6,090,056 (Jul. 18, 2000); Sherman et al., *Modular CPR assist device*, U.S. Pat. No. 6,066,106 (May 23, 2000); and Sherman et al., *Modular CPR assist device*, U.S. Pat. No. 6,398,745 (Jun. 4, 2002); and our application Ser. No. 09 866,377 filed on May 25, 2001, and our application Ser. No. 10/192,771, filed July 10, 2002 show chest compression devices that compress a patient's chest with a belt. Each of these patents or applications is hereby incorporated by reference in their entireties.

Since seconds count during an emergency, any CPR device should be easy to use and facilitate rapid deployment of the device on the patient. Our own devices are easy to deploy quickly and may significantly increase the patient's chances of survival. Nevertheless, a novel chest compression device has been designed to further increase ease of use, further facilitate rapid deployment and further increase the durability and convenience of the device.

SUMMARY

The devices and methods described below provide for an electro-mechanical chest compression device that weighs less than 30 pounds when fully assembled. The device is provided with a channel beam to strengthen the device at the points where most of the force of compressions is applied, thereby making it possible to create a hollow device and to use lighter weight materials. The channel beam also serves as a mount onto which a compression belt cartridge may be installed, thereby allowing the belt to be easily changed after each use. A slotted drive spool spans the channel beam. The drive spool is attached to a motor that is capable of rotating the drive spool. Spindles are disposed on either end of the channel beam to guide the belt during compressions and assist in conserving energy.

In use, a compression belt cartridge is provided, the belt is attached to the slot in the drive spool and the belt is extended over and around the spindles. The cartridge cover plate is then attached to the channel beam. The patient is placed then on the device and the belt is secured over and around the patient's chest. When the motor rotates, the belt spools around the drive spool, thereby tightening the belt.

Sufficient torque is generated that the belt compresses the patient's chest.

DETAILED DESCRIPTION OF THE INVENTION

Figure 1:
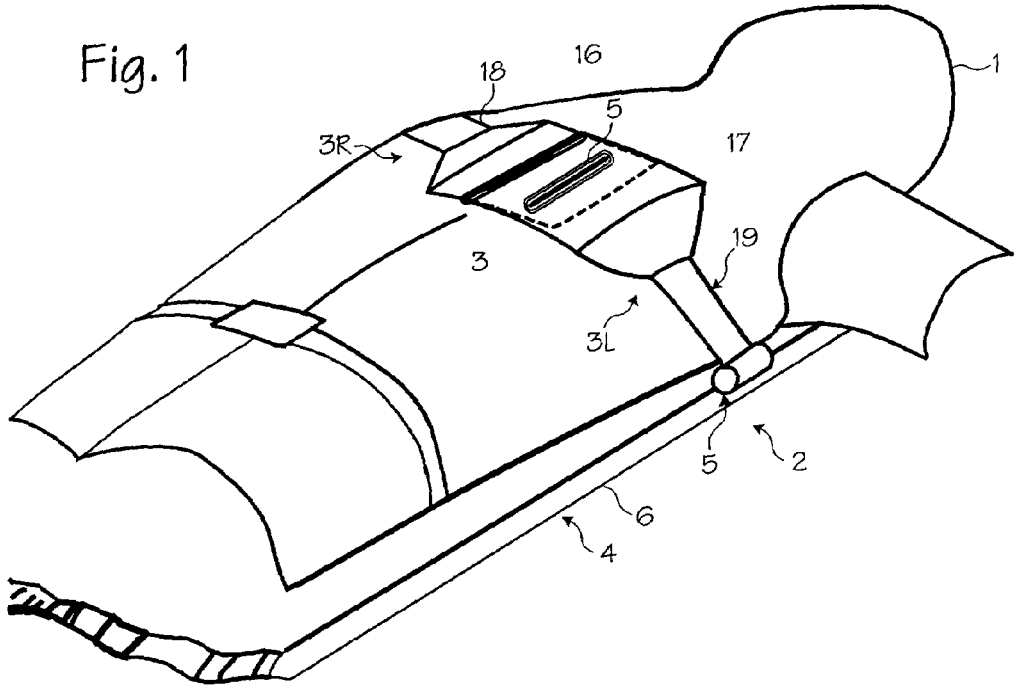
FIG. 1 illustrates a method of performing chest compressions on a patient by using an automatic chest compression device.

FIG. 1 shows the chest compression belt fitted on a patient 1. A chest compression device 2 applies compressions with the belt 3, which has a right belt portion 3R and a left belt portion 3L. The chest compression device 2 includes a belt drive platform 4 and a compression belt cartridge 5 (which includes the belt). The belt drive platform includes a housing 6 upon which the patient rests, a means for tightening the belt, a processor and a user interface disposed on the housing. The belt includes pull straps 18 and 19 and wide load distribution sections 16 and 17 at the ends of the belt. The means for tightening the belt includes a motor attached to a drive spool, around which the belt spools and tightens during use. The design of the chest compression device, as shown herein, allows for a lightweight electro-mechanical chest compression device. The fully assembled chest compression device weighs only 29 pounds, and is thus hand-portable over long distances. (The device itself weighs about 22.0 to 23.0 pounds, the battery weighs about 5.0 pounds, the belt cartridge weighs about 0.8 pounds and the straps to secure the patient weigh about 1.6 pounds.) To date, the chest compression device described below is the only self-contained electro-mechanical or belt-based automatic chest compression device known to the inventors that weighs less than 30 pounds.

Figure 2:
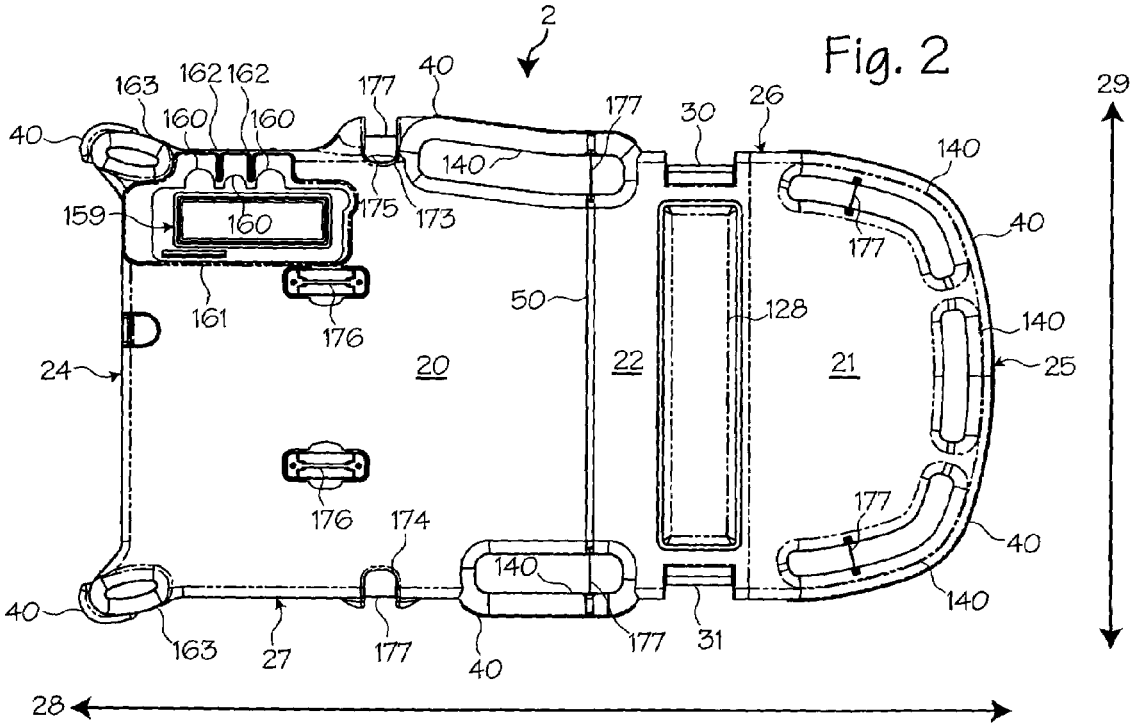
FIG. 2 shows the anterior side of an electro-mechanical chest compression device.

FIG. 2 shows the anterior side of an electro-mechanical chest compression device 2. The chest compression device includes the belt drive platform 4 and the belt cartridge 5. The belt drive platform includes a headboard 20, upon which the patient's head rests, and a backboard 21, upon which the patient's back rests. Preferably, the headboard and backboard are part of one, integral plate of material. The chest compression device 2 is described in relation to the patient when the patient's back is on the backboard and the patient's head is on the headboard. Thus, in normal use, the top of the device is the anterior side 22 (the side upon which the patient rests during use), the bottom of the device is the posterior side 23 (the side facing the ground during use, shown in FIGS. 3 and 4), the front of the device is the superior side 24 and the back of the device is the inferior side 25. The left side 26 and right side 27 of the device are to the left and right of the patient, respectively, when the device is in use.

The device is lightweight and compact. The superior-inferior height of the device (along arrow 28) is about 32 inches and the lateral width of the device (along arrow 29) is about 19 inches. The anterior-posterior thickness of the device is about 3 inches. The distance between a left belt spindle 30 and a right belt spindle 31 is in the range of about 12 inches to about 22 inches. Preferably, the distance between the spindles is about 15 inches so that the device will accommodate the vast majority of patients. Specifically, the distance is measured from the lateral, outer edge of one spindle to the lateral, outer edge of the other spindle. (The device may be made larger to accommodate very large patients.)

Figure 3:
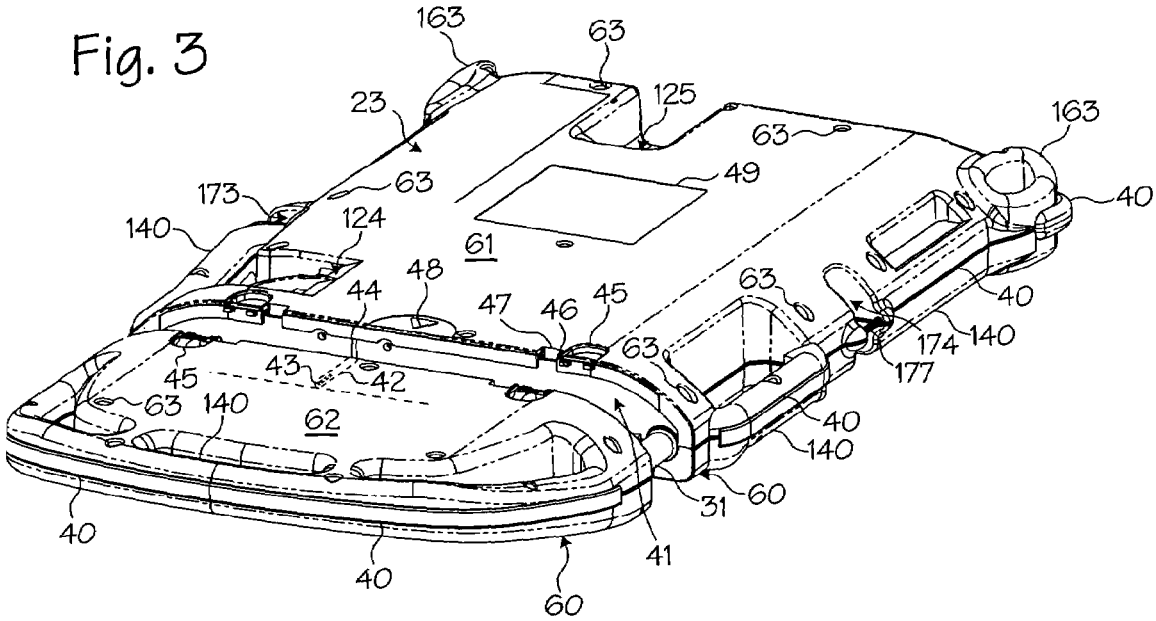
FIG. 3 shows the inferior and posterior sides of the automatic chest compression device.
Figure 4:
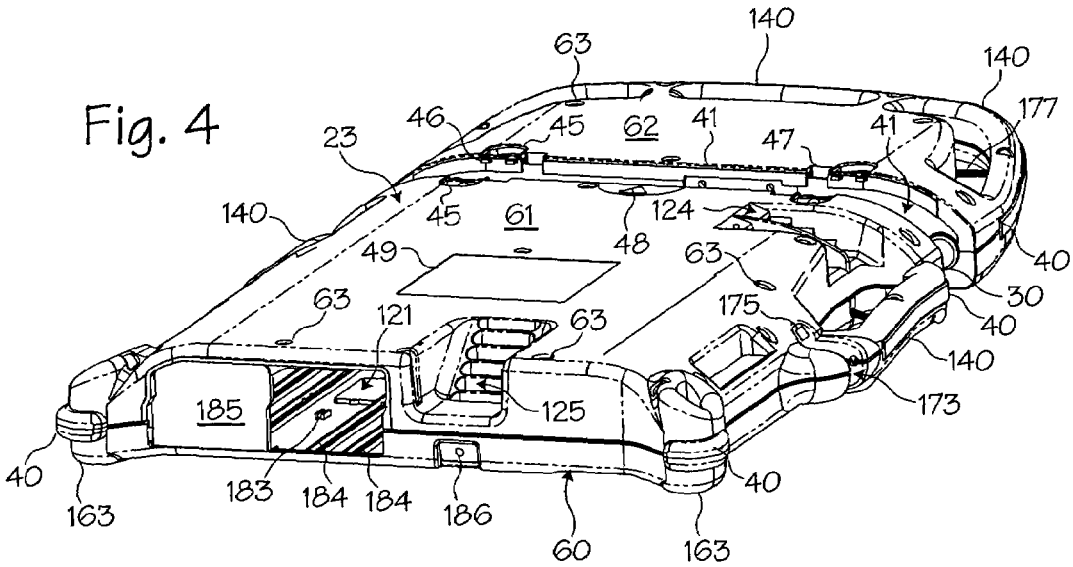
FIG. 4 shows the superior and posterior sides of the automatic chest compression device.
Figure 5:
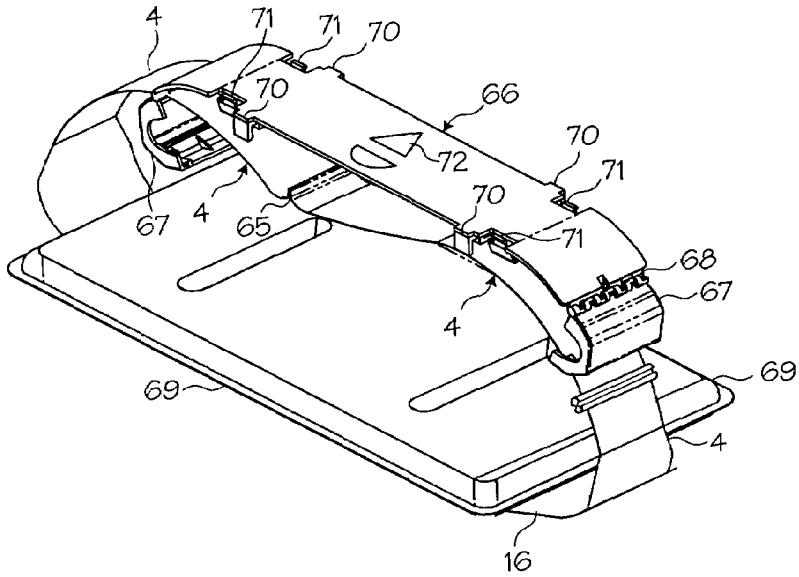
FIG. 5 shows a compression belt cartridge for use with the chest compression device.

In use, a belt cartridge is provided and is secured to the posterior side of the chest compression device, as described in reference to FIGS. 3 through 5. The patient is then placed on the device. The belt extends over and around the left spindle and the right spindle, under the patient's axilla (armpits) and around the patient's chest. The load distribution sections are then secured over the patient's chest. The chest compression device then tightens the belt repetitively to perform chest compressions.

FIGS. 3 and 4 show the posterior side 23 of the chest compression device as seen from the inferior and superior directions, respectively. (In the perspective of FIGS. 3 and 4, the average sized patient's buttocks and the back of the patient's legs would extend past the inferior bumper 40.) The device is built around a sturdy channel beam 41 that is laterally oriented with respect to the housing. The channel beam supports the device against the forces created during compressions. The channel beam also serves as the structure to which the belt cartridge is attached. The channel beam 41 is formed from a single piece of cast aluminum alloy that forms two walls perpendicular to a flat bottom portion. (The channel beam may be formed from separate components and of other suitably strong and stiff materials, such as steel, magnesium, or reinforced polymer composites.) To accommodate the belt, the channel beam is about 2.5 inches high (along the superior-inferior direction), about 12 inches to about 16 inches long (along the left-right direction) and about 2 inches deep (from the bottom portion to the top of a wall portion).

The channel beam 41 forms a channel extending across the lateral width of the device. During compressions, the belt is disposed in and travels along the channel. The belt is attached to a drive spool 42 that spans the channel. The drive spool serves as a means for operably connecting the compression belt to the motor. (The drive spool is shown in phantom in FIG. 3 to indicate its position near the bottom surface of the channel beam.) The drive spool is less than 3 inches long and less than 1 inch in diameter. The drive spool maybe located anywhere within the channel beam. Preferably, the drive spool extends across the channel beam at a location slightly offset from the vertical centerline of the device.

For example, the drive spool may have a conical shape for use with a cable attached to the pull straps (or when the belt is replaced with a cable). During initial spooling, the cable wraps around the base of the cone, thereby creating a large mechanical advantage when starting a compression. The cable then spools around the length of the cone, proceeding towards the peak of the cone. The drive spool applies more torque to the cable as the cable spools around the smaller diameter portions of the cone, thereby applying a greater force to the patient towards the end of a compression when the chest's resistance to the compression is highest. (The shape of the drive spool is the spooling profile of the device. The spooling profile may be customized to take advantage of the speed versus torque trade-off from the drive train or from the viscoelastic effects of the patient's chest).

The drive spool is provided with a slot 43 disposed along the length of the spool shaft. A spline attached to the belt is keyed to the shape of the drive spool slot. Thus, when the spline is inserted into the drive spool slot, the belt is securely fastened to the drive spool. A groove 44 in the channel beam walls assists in aligning and securing the spline to the drive spool slot. Similarly, one or more discs or guide plates mounted on one or both walls of the channel beam also assist in aligning and securing the spline to the drive spool slot. (The guide plate may also be operably attached to the drive spool or both the drive spool and the channel beam.) The guide plate is attached to a spring that allows the guide plate to move in and out of the channel, thereby allowing easy removal of the spline. When the guide plate springs back after insertion of the clip, the guide plate helps secure the spline in place. The guide plate may be provided with a slot sized and dimensioned to receive the spline, thereby further securing the spline within the drive spool slot.

The left spindle 30 and right 31 spindle are disposed on either end of the channel beam 41 and are mounted to the channel beam walls via sealed bearings. The spindles are hollow aluminum cylinders, having a length of about 2.5 inches and a diameter of about 0.75 inches, to minimize weight and to minimize their moments of inertia. The left and right spindles allow the compression belt to easily travel around the left and right sides of the device with a minimum of friction, thus conserving energy. The left and right spindles are disposed along the superior-inferior direction of the device such that the belt will easily wrap around the patient's chest when the patient is placed on the device. The spindles are inset into the sides of the housing in order to protect the patient, rescuer and device components. Belt guards disposed on the belt cartridge, shown in FIG. 5, also cover the spindles. The belt guards further protect the patient, rescuer and device components.

Also disposed on or near the channel beam are means for securing the compression belt cartridge to the channel beam. For example, a number of blind holes or slots 45 are disposed in the housing and along the edge of the channel beam. Corresponding alignment tabs disposed on the compression belt cartridge fit within the slots. The slots also have bosses or detents 46 that extend outwardly and into the channel a short distance. Snap latches disposed on the compression belt cartridge fit securely, though removably, within the bosses or detents. Similarly, a number of apertures 47 are disposed in the housing and along the edges of the channel beam 41. The compression belt cartridge is provided with tabs or hooks that fit into the apertures, thus further securing the cartridge to the channel beam. The slots and apertures are symmetrically located about the medial axis of the device. However, placing the slots and apertures asymmetrically about the medial axis of the device can ensure that the cartridge is attached to the channel beam in only one orientation.

In addition, the housing is provided with labeling, such as triangle 48, to assist a user with correctly attaching the compression belt cartridge. Labeling on the housing aligns with corresponding labeling disposed on the compression belt cartridge when the cartridge is correctly aligned with the device. Contrasting colors are used in the region of the triangle to further assist the user to align the cartridge. Additional labeling 49 may be added to the device to aid in aligning the patient with the device, or to provide warnings, operation instructions or advertising information. For example, recess 50 (shown in FIG. 2) disposed across the width of the device provides a visual alignment marker. The recess 50 also helps fluids to flow away from the surface of the device.

Although the channel beam 41 forms the backbone of the device, additional reinforcement for the device is provided by the device housing. Referring again to FIGS. 3 and 4, the shell housing comprises an anterior cover plate 60 attached to two posterior cover plates, a superior cover plate 61 and an inferior cover plate 62. The anterior cover plate is attached to the superior cover plate and the inferior cover plate via a plurality of threaded fasteners disposed in holes 63 or by interlocking features that snap together.

The superior cover plate 61 is disposed superiorly to the channel beam 41 and the inferior cover plate 62 is disposed inferiorly to the channel beam. (The housing may be formed from more or fewer cover plates, although using three cover plates is a preferred design with the devices shown in the FIGS. 2 through 7.) The three-piece shell design minimizes shear forces applied to the fasteners connecting the cover plates, thereby increasing the durability of the device. (The channel beam absorbs most shear forces.) In addition, the posterior edges of the channel interlock with ridges in the superior and inferior cover plates to protect the fasteners connecting the cover plates to the channel. Alignment pins and bumpers interdigitate with the overlapping cover plates, thereby providing further protection from shear forces.

The housing is constructed with rounded edges to minimize impact damage to people or to the device. The housing is formed from a hard, liquid-proof material that is easy to clean, has low thermal conductivity and is resistant to fire, electricity, chemicals, sun exposure and extreme weather conditions. (Such materials include acrylonitrile butadiene styrene, high molecular weight polyethylene, other polymer plastics and lightweight metals such as aluminum and titanium; however, metals should be provided with a coating or other feature to make the housing non-conducting.) FIG. 5 shows a compression belt cartridge for use with the chest compression device. The cartridge has a belt 3, a spline 65 for attaching the belt to the chest compression device, a belt cover plate 66 for protecting the belt, and belt guards 67 rotatably attached to the belt cover plate via hinges 68. (The belt guards are disposed around the spindles during use.) The belt cartridge may also be provided with a compression bladder 69, which is placed between the belt and the patient's sternum during compressions. An example of a compression bladder is shown in our application Ser. No. 10/192,771.

To attach the belt cartridge to the chest compression device, the belt spline 65 is inserted into the drive spool slot 43. The belt cover plate 66 is then secured to the channel beam 41 and housing 6 by inserting hooks 70 on the belt cover plate into the corresponding apertures 47 in the device and by inserting tabs and snap latches 71 within the slots 45 and bosses on the device. (The slots, apertures, tabs and hooks are aligned and begin sliding together prior to engagement of the snap latches within the bosses.) Labeling 72 disposed on the belt cover plate further assists the user to align the belt cover plate with the channel beam.

Figure 6:
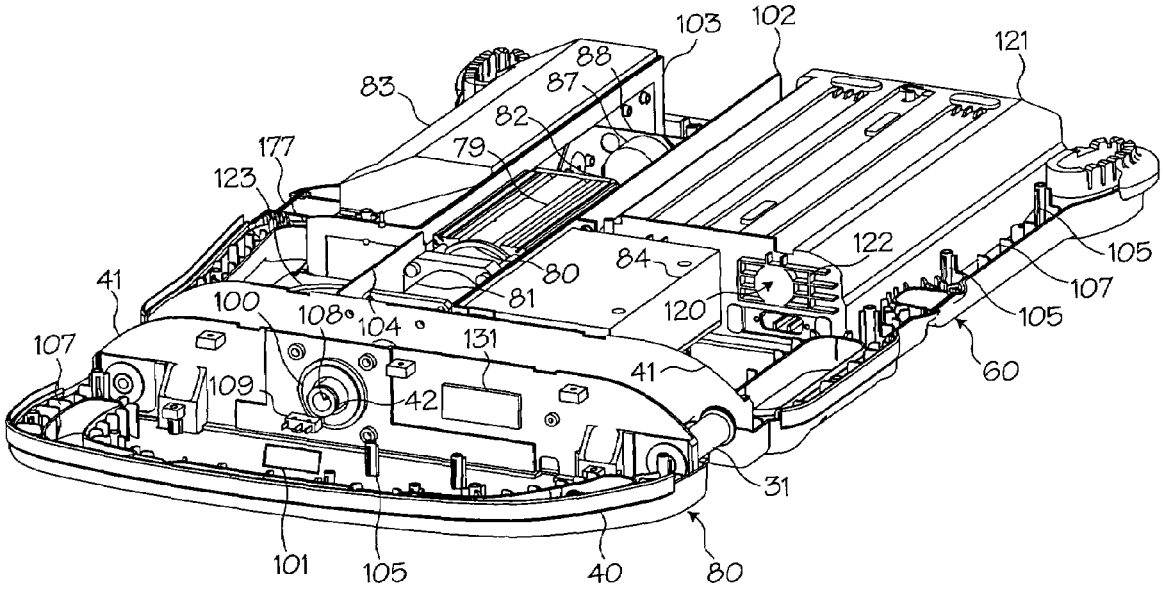
FIG. 6 shows the inferior and posterior sides of the automatic chest compression device with the superior and inferior cover plates removed.
Figure 7:
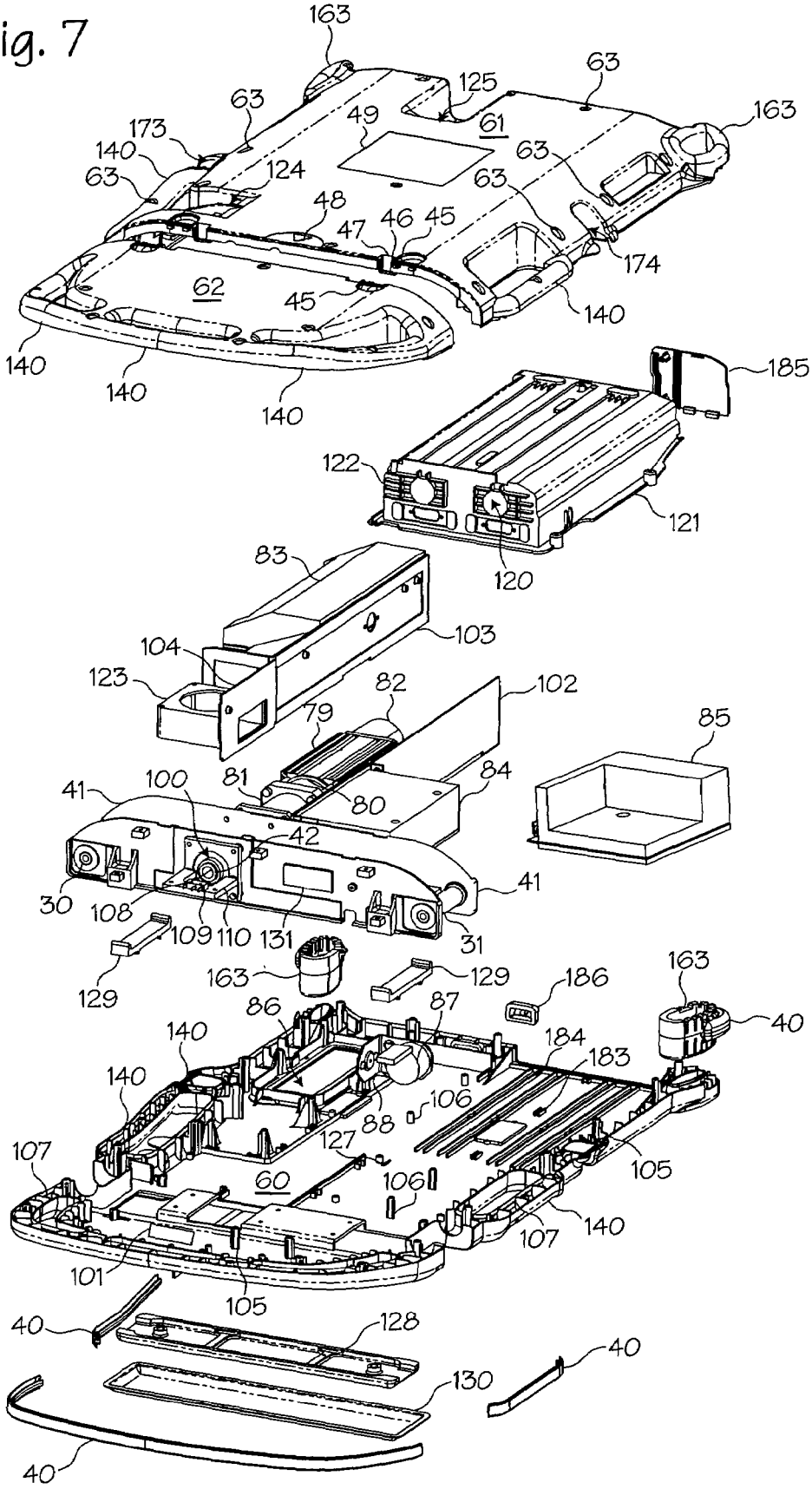
FIG. 7 shows an exploded view of the automatic chest compression device as seen from the posterior side of the device.

FIGS. 6 and 7 show the internal components of the chest compression device 2. A motor 79 is operable to provide torque to the drive spool 42 through a clutch 80 and a gearbox 81. A brake 82, attached to the superior side of the motor, is operable to brake the motion of the drive spool. The brake hub connects directly to the rotor shaft of the motor.

The drive spool extends across the channel is rotatably attached to the walls of the channel beam via bearings. Together, the drive spool, clutch, gearbox and brake compose the drive train of the device. Preferably, the drive train is not attached to any other component of the device or to the device housing, except via attachment of the drive spool to the channel beam. Thus, the drive train is cantilevered from the channel beam. When cantilevered from the channel beam, the drive train minimizes rotational resistance and rotational inertia, reduces undesirable bending or shearing forces on the components of the drive train, reduces the weight of the overall device and improves air flow around the components of the drive train (thereby improving cooling of those components).

The gearbox contains a gear system having a gear ratio that decreases the speed of the drive spool relative to the clutch or motor drive shaft. The gear ratio preferably about 10:1. Useable gear systems include planetary gear systems that operate in a straight line from the motor shaft to the output shaft (which is the drive spool shaft). Still other gear systems do not operate in a straight line, so that the motor and output shafts need not be along the same line. In the device shown in FIGS. 6 and 7, the drive spool is the output shaft of the gearbox.

The clutch disengages the motor from the gearbox if too much torque is applied to the drive spool. The control system can also disengage the clutch based on other sensed parameters; for example, the controller can control the clutch to disengage when too much load, as pre-determined by the manufacturer, is sensed at the load plate, when there is a software error or upon other conditions. Thus, the clutch serves as a safety mechanism for the chest compression device. optionally, the clutch can be used actively during compressions to aid in timing compressions and conserving energy. An example of this use for a clutch is found in our U.S. Pat. No. 6,142,962. Preferably, the brake, motor, gearbox, clutch and drive spool are aligned in a straight line, perpendicular to the channel beam 41.

The motor 79 and brake 82 are controlled by a processor unit 83, motor controller 84 and power distribution controller 85, all of which are mounted to the inside of the anterior cover plate 60. (The power distribution controller is not shown in FIG. 6 in order to clearly show the end of the battery compartment.) The processor unit includes a computer processor, a non-volatile memory device and a display. A user may access the display through opening 86 in the housing. Additional feedback is given to the user though speaker 87 mounted on bracket 88.

The processor unit is provided with software used to control the power controller and the motor controller. Together, the processor unit, power controller and motor controller make up a control system capable of precisely controlling the operation of the motor. Thus, the timing and force of compressions are automatically and precisely controlled for patients of varying sizes. Examples of compression belt timing methods may be found in our U.S. Pat. No. 6,066,106 and in our application Ser. No. 09/866,377.

The motor controller may also be operably connected to a torque sensor that senses the torque applied by the motor to the drive spool. In this case, the motor controller is capable of automatically stopping the device if the torque exceeds a pre-set threshold. The motor controller or processor may also be attached to a biological sensor that senses a biological parameter, such as end-tidal carbon dioxide, pulse or blood pressure. The processor and motor controller are then operable to control the operation of the device based on the sensed biological parameter. Examples of motor control and biological feedback control are found in our patent, Mollenauer et al., Resuscitation Device Having a Motor Driven Belt to Constrict/compress the chest, U.S. Pat. No. 6,142,962 (Nov. 7, 2000). The motor controller or processor may also be attached to a current sensor operable to sense the current in the motor. A sudden spike in the motor current indicates a sudden load on the motor, and is thus an indication of how much torque is being applied to the patient. Accordingly, control system may control the operation of the device based on the measured current in the motor.

The processor unit is also attached to a rotary encoder 100 disposed in the inferior portion of the housing and mounted on the channel beam 41. (The rotary encoder may be replaced with a linear encoder operably disposed with respect to the belt.) The rotary encoder measures the rotation of the drive spool 42 and produces spool data corresponding to drive spool rotation. The processor, together with an encoder controller 101 mounted in the inferior portion of the housing, translates the spool data into the total amount of belt take-up and into the total depth of compression accomplished by the system. The encoder controller converts pulses from the encoder into a count and direction signal, and the processor uses that signal to control the device. (The encoder controller and the encoder may be located elsewhere in the device; for example, the encoder may be located in the gearbox and operably connected to one of the gear shafts.) Examples of encoders as used with chest compression devices are found in our patent, Sherman et al., Modular CPR assist device, U.S. Pat. No. 6,066,106 (May 23, 2000) and in our application Ser. No. 09/866,377 filed on May 25, 2001.

Referring again to FIGS. 6 and 7, a number of additional features are provided to the device to increase its utility and safety. Additional reinforcement for the device is provided by ribs 102, 103 and 104. The ribs are metal plates that support the housing during use, thereby protecting the device and device components. All ribs are disposed in the same plane as the motor to conserve space. More ribs may be added to provide further reinforcement to the device. The edges of the ribs are sealed with foam so that any liquid that does enter the device will not contact the controller board, power distribution board, motor controller, other electronics and associated cables.

Further reinforcement is provided by hollow posts 105 integrally formed with the housing cover plates. The hollow posts are open at one end where the threaded fasteners are inserted to connect the cover plates to each other. (The openings in the posts correspond to the holes 63 in FIGS. 3 and 4) Additional, internal mounting posts 106 are provided to mount electronic systems and suspend them off the floor of the device. Thus, the internal mounting posts help prevent any liquids that enter the device from pooling on the electronics. Still further reinforcement is provided by gussets 107 mounted throughout the device housing. The multiply redundant reinforcements and the tight-fitting compartmentalized design of the device provide very high protection against force, shock and vibration. The device shown in FIGS. 2 through 7 can resist more than 1,200 pounds of distributed force.

To protect the patient and users from accidental activation, or activation when a belt is not secured to the device, a means for sensing the presence of the belt is provided. The drive spool slot 43 is provided with a pin 108 that is longitudinally translatable through the drive spool and the rotary encoder. The pin is attached to a spring that urges the pin into the drive spool slot. When a belt spline is inserted into the drive spool slot, the pin is pushed through the drive spool and rotary encoder and towards a contact switch 109. The contact switch is mounted on brace 110 that is itself mounted to the channel beam 41. The contact switch is operably connected to the encoder controller (and thereby to the processor). When the belt is inserted, the pin is pushed against the contact switch and the device thereby registers the presence and proper insertion of the belt spline. To provide additional safety, the spline is keyed to the drive spool slot so that movement of the pin towards the contact switch is difficult unless the spline is inserted into the slot. Other means for sensing the presence of the belt may be used; for example, the drive spool slot may be provided with an electrical contact that senses the presence of the belt.

In addition, the spool shaft is provided with a detent that locks the shaft in place when the spline is removed. The detent holds the spool shaft at a particular position to aid in insertion of the spline. Holding the spool shaft at a particular position also maintains the relationship between the actual physical position of the spool and the position of the spool as measured by the control system. Thus, the starting position of the spool shaft does not change while the device is turned off. This, in turn, helps to maintain the accuracy of measuring the actual amount of belt travel during compressions.

The chest compression device is provided with a control system that controls how the belt is wrapped around the drive spool. For example, the drive spool is controlled so that some of the belt is left wrapped around the drive spool between compressions (that is, when the device has loosened the belt around the patient, just before beginning the next compression). Preferably, a length of the belt corresponding to one revolution of the drive spool is left wrapped around the drive spool at all times during compressions. Thus, the belt will maintain its curled shape, reduce the chance of causing folds in the belt during compressions and increase the efficiency of spooling the belt around the drive spool.

FIGS. 6 and 7 also show the location of the battery compartment near the head of the patient. The location and design of the battery pack and battery compartment allow for rapid exchange of batteries. A spring in the back of the compartment forces the battery pack out unless the battery pack is fully and correctly inserted in the compartment. Recesses 120 indicate the location of the springs inside the battery compartment 121. Plastic grills 122 at the end of the battery compartment reinforce the recesses.

To cool the device and the device electronics, a blower 123 is provided to circulate air inside the device. Outside air is drawn in from either the left louvered vent 124 or the superior louvered vent 125 and is expelled from the other vent, thereby assisting in cooling the device components. (In the devices shown in FIGS. 2 through 7, air is drawn in the left vent and is blown out the superior vent.) The vents are disposed in inwardly sloping recesses that are disposed in the housing. The recesses help prevent liquids from entering the vents.

Temperature inside the housing is measured with a temperature sensor 127, such as a thermometer or thermistor, mounted on the inside of the anterior cover plate. If the temperature exceeds a pre-set temperature, then the processor is programmed to control the systems of the device to cool the device. For example, the processor may increase the speed of the blower, reduce motor speed or prompt the user to clear blocked vents or move the patient and device to a cooler location.

A means for measuring force is operably attached to the device. The means for measuring force is operable to measure the force the patient applies to the device and the force of compressions. The means for measuring force is a load plate 128 attached to two load cells 129. Other means for sensing force or weight may be used, such as one or more strain gauges or springs operably attached to the channel beam. A load plate cover 130, made from a high-density polyethylene polymer, Santoprene rubber or similar materials, is also provided to seal the inside of the device from liquids and other contaminants.

A back-up battery may also be provided with the system to provide power when the main batteries are not attached. The back-up battery is mounted to a mounting plate 131 on the channel beam 41. The mounting plate is a thickened region of the channel beam itself, though the mounting plate may be a separate component mounted to the channel beam.

Figure 8:
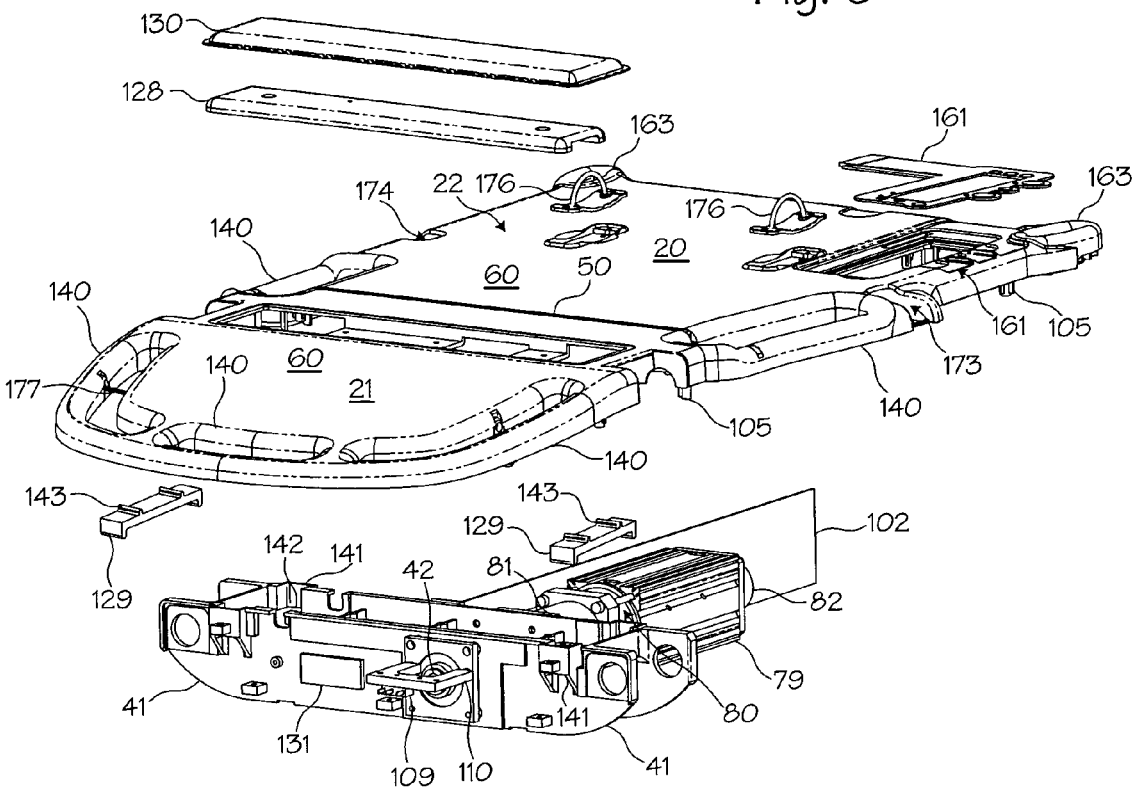
FIG. 8 shows an exploded view of part of the automatic chest compression device, as seen from the anterior side of the device without some posterior elements.

FIG. 8 shows an exploded view of part of the automatic chest compression device 2, as seen from the anterior side 22 of the device. The device is shown in an orientation corresponding to when the device is laying on the ground and in use. The patient's head is placed on the headboard 20 portion of the anterior cover plate 60, the patient's torso is placed on the load plate 128, the patient's back is placed on the backboard 21 portion of the anterior cover plate 60 and the patient's legs and buttocks extend past the handles 140 on the inferior side of the device.

FIG. 8 also shows the load cells 129 in relation to the channel beam 41. The load cells are mounted to the channel beam by placing the load cells in load cell slots 141. The load cells rest on shoulders 142 provided in the slots. Bosses 143 disposed on the load cells contact the load plate so that the load cells can measure the force applied to the load plate 128. Thus, the load cells can measure the force applied by the patient's thorax and the device to the load cell, and this corresponds to the total compressive force applied to the patient.

The load cells use a strain-based method to transduce applied loads into an electrical signal. (Other load measuring devices may be used, such as resistors, capacitors, pneumatic actuators, piezoelectric actuators and other means for measuring force or pressure.) The processor and software control the operation of the device based on the load signal generated by the load cells. For example, the device determines how much force to apply based, in part, on the weight of the patient on the load plate. The device also monitors the force of compressions and prevents excessive force from being applied to the patient. An excessive compressive force is between about 600 pounds to about 1000 pounds (over the entire area of the load distribution sections), depending on the patient and the embodiment used.

Figure 9:
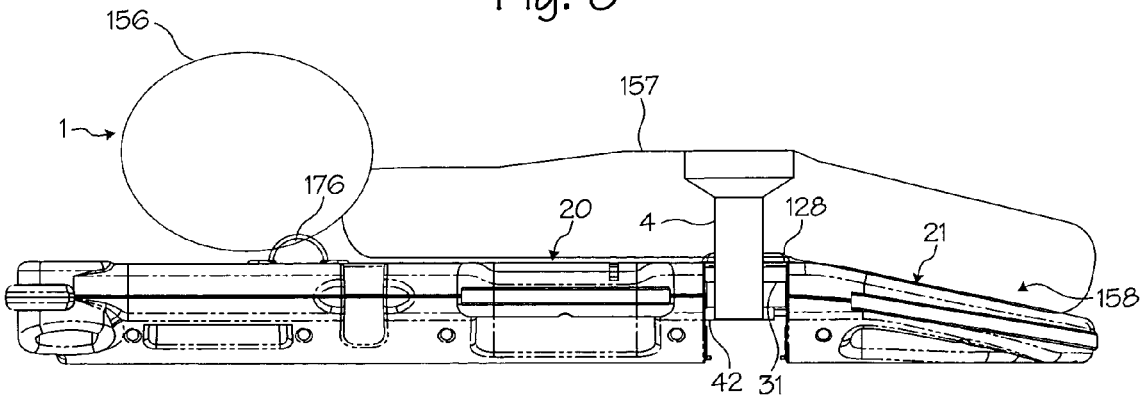
FIG. 9 illustrates a method of performing chest compressions on a patient when viewed from the side.

FIG. 9 illustrates a method of performing chest compressions on a patient 1. The patient's head 156 rests on the headboard 20 between the loops 175, the patient's chest 157 rests over the load plate 128, the lumbar portion of the patient's back 158 rests over the backboard 21 of the housing and the patient's hips and legs extend past the inferior handles 140 (the hips and legs rest on the ground, gurney or other surface while the device is in use). The belt 3 extends from the drive spool 42, around the spindles 30 and 31 and over the patient's chest. In use, the drive spool tightens the belt as the motor turns the drive spool, thereby compressing the patient's chest.

As shown in FIG. 9, the backboard portion 21 of the device is provided with an ergonomic shape for both the patient and the device operator. The patient's head can be easily tilted, as recommended by current AHA guidelines. The design also allows easy endotracheal intubation and visualization during endotracheal intubation. The backboard design also allows for safe and easy immobilization of the patient's head, torso and hips. The backboard also is shaped to reduce back strain on the patient. Specifically, the backboard portion of the housing slopes toward the ground toward the inferior end of the belt drive platform. The device thereby accommodates the lumbar curve in the patient's back when the patient rests on the backboard.

Referring again to FIG. 2, the device is provided with a number of additional features to make it user-friendly and durable. A plurality of ergonomic handles 140 are provided to allow a user to carry the device in several different orientations, or to allow multiple people to carry the device when a patient is laying on the housing. The sides of the device are shaped so that the top of the device gently slopes towards the bottom of the device. (In other words, the anterior portion of the left and right sides of the device gently curves towards the posterior portion of the left and right sides of the device.) Thus, the handles 140 and air vents 124 and 125 are raised slightly from the ground when the device is placed on the ground. This shape helps to prevent liquids from entering the louvered vents. The shape also allows a user to more easily lay the device on the ground without scraping his or her fingers and to more easily lift or shift the position of the device. In addition, the shape also makes it easier to laterally roll the patient over the side of the device.

A user interface 159 is placed near the patient's head on the left side of the device to allow a rescuer to easily interact with the device during use and to reduce interference from a patient's clothes or body parts. The user interface is provided with color-coded switches or buttons 160 for ease of use. (The preferred embodiment uses membrane-type buttons with a low profile or a touch screen.) The user interface is recessed into the housing to reduce inadvertent activation of buttons or other interfaces. The user interface is also covered with a plastic cover 161 to prevent liquids from damaging the interface. One or more slots 162 are placed in the user interface recess so that liquids can drain out of the recess.

Also shown in FIG. 2 are bumpers 40 that are attached to the ears Error! Bookmark not defined. and to the sides of the device. The bumpers provide further protection against shock and vibration. The bumpers also help prevent the device from slipping when the device is leaned against walls or other objects. The bumpers on the ears are thicker than the bumpers on the other portions of the device. All of the bumpers are made from a thermoplastic elastomer compound, such as Dynaflex produced by GLS Corporation, although rubber and other elastomeric materials may be used. Preferably the bumpers are shaped, sized and dimensioned to fit between the housing cover plates so that the bumpers also serve as gaskets. Additional gaskets are provided to further seal the device. The entire perimeter of the device, including the edges of the spindles and the channel beam, is sealed by a combination of gaskets, adhesives and compressed rubber seals.

A left niche 172 and a right niche 173 are provided in the left side 26 and right side 27 of the housing, respectively, between the ears and the handles. The niches allow additional straps to be secured to the device. In addition data port 174 is disposed on the edge of the housing, tucked into one or both niches. The data port allows the device to communicate with other devices or processors. The data port may be an infrared port, Bluetooth port, Ethernet cable, phone jack, USB port, wireless transmitter or any other suitable means for transferring data. (The data port may be disposed elsewhere on the device.)

FIGS. 2 and 9 also shows a number of flexible loops 175 that are attached to the headboard portion of the housing. The flexible loops are metal cables coated with plastic. A head restraining strap, or other head restraint, may be threaded through or attached to the loops and placed around the patient's head or shoulders. The head restraint secures the patient's head to the device during treatment and transport. (The flexible loops may be replaced with some other means for securing the patient's head to the device such as a built-in head restraint frame.)

A plurality of tie-downs 176 are also provided to serve as objects around which straps or other restraints may be placed. (Thus, the device may be easily secured to a gurney or bed, or the device may be easily secured to the patient for transport.) The tie-downs are mounted to the handles 140 and within the niches 172 and 173. The tie-downs may be made rotatable within the housing so that the tie-downs may act as spindles for straps disposed around the tie-downs. The tie-downs also serve as reinforcements for the handles.

All of the fasteners used to secure the various components of the device are disposed either within the device or on the posterior side of the housing (the bottom of the device when in use). The fasteners are also set into the housing in holes so that no fasteners will catch on clothing or other objects. The fasteners are all plastic to prevent electrical currents from flowing between the inside and the outside of the device. Moreover, fluids spilled on the anterior side of the device will not accumulate in fastener holes, thereby making the device more resistant to fluids. (The threaded fasteners may be replaced with latches or snap latches to increase the ease of opening the device.)

Referring again to FIGS. 3 and 4, the device is provided with more features to increase its utility. A battery compartment 121 disposed inside the superior end of the device holds one or more batteries designed to fit within the compartment. Pinned electrical connectors in the battery compartment electrically connect the batteries to the device. The electrical connectors are provided with foam seals or gaskets that are compressed when a battery is connected to the device. The foam seals seal the electrical connection from liquids.

The floor of the compartment (on the inside of the superior cover plate) is provided with a notch, boss or detent that receives a corresponding spring latch on the rectangular battery pack. Thus, a battery pack audibly snaps into place when secured in the battery compartment.

The battery compartment, or the opening to the compartment, is shaped to match specific battery packs. Thus, batteries not designed to work with the device may not be inserted into the compartment or used with the device. Likewise, the shape of the compartment ensures that the battery pack is correctly inserted. Alignment ridges 182 disposed in the compartment further aid in aligning and inserting battery packs. In addition, flexible metal strips may be disposed between rails 183 mounted in the roof of the compartment (on the inside of the anterior cover plate). The metal strips are bent slightly away from the rails. The metal strips impart a force to a battery pack that urges a pack towards the floor of the compartment. Thus, the rails help to secure the battery pack within the compartment and help to align the battery with the electrical connector as the battery slides in.

The battery compartment 121 is sealed from liquids and other contaminants by the battery compartment cover plate 184. A gasket or seal may be provided between the compartment cover plate and the housing to further prevent entry by liquids.

To indicate battery status, the device or the battery pack (or both) may be provided with a means for displaying battery status that is operably attached to a means for determining battery status. For example, an LED can be added to a battery pack to indicate the status of the batteries, or the processor can be programmed to display battery status on the display.

A power switch 185 is disposed on the superior side of the device and is recessed into the housing to help prevent inadvertent activation. The power switch is a button protected by a flexible, waterproof cover, though a flip-switch or other means for activating and deactivating the device can be used. The power switch may be disposed elsewhere on the housing.

Protection from electric shocks or surges is provided by the channel beam, which serves as a grounding element. In addition, a thin, metallic coating on the inside of the enclosure is connected to the channel beam. The metallic coating conducts stray electrical currents to the channel beam and grounds them. The coating also limits electromagnetic emissions from the device, thereby protecting patients with pacemakers or other electrical medical equipment. The housing is also made from a non-conducting material to further improve electrical insulation. Other forms of electrical insulation or protection may also be provided to the device.

Additional safety features may be added to the device; for example, the device can be designed so that the device will not operate without a key. Likewise, multiple motions may be required to activate certain functions; for example, a twisting and pushing motion may be required to activate and deactivate the device. Alternatively, two or more buttons, possibly operated in a particular sequence, may be required to activate the device. Moreover, the device can provide different users with different levels of access to device functions depending on the training of the user. Examples of tiered access emergency devices are found in our U.S. Pat. No. 6,398,744.

The processor is also capable of monitoring the status of the device and taking appropriate action depending on certain events. For example, the device can call 911 or a central operating center when the device is activated. The device may also inform a customer or a manufacturer when the batteries are running low or when the batteries have reached the end of their service life. Examples of device monitoring may be found in our U.S. Pat. No. 6,142,962.

The device may be made larger so that the entire patient rests on the device, or the housing may be provided with a telescoping plate that extends outwardly from the device. The telescoping plate allows the patient's legs to rest on the device when in transport, yet allows the device to be more portable when not in use. (The plate need not be telescoping, but may be connected to the rest of the housing by hinges or other suitable means for connecting the plate to the rest of the housing.) Similarly, the device may be provided with storage compartments to house additional equipment, such as gloves, respirators, ECG monitors, blood pressure monitors, pulse oximeters, pulse detectors, end-tidal carbon dioxide monitors, defibrillators or other emergency equipment.

In addition, one or more kickstands or braces can be added to the device. If the device must be operated on an uneven surface, the kickstands or braces stabilize the device during use. Thus, while the preferred embodiments of the devices and methods have been described in reference to the environment in which they were developed, they are merely illustrative of the principles of the inventions. Other embodiments and configurations may be devised without departing from the spirit of the inventions and the scope of the appended claims.

We claim:

1. An electro-mechanical chest compression device comprising:

a housing for supporting a patient's back;

a motor disposed in the housing below the patient when the patient is supported by the housing;

a channel beam mounted to the housing, said channel beam laterally oriented with respect to the patient and defining a channel that extends laterally across the width of the housing;

a drive spool spanning the channel beam, said drive spool operably attached to the motor and rotatably attached to the channel beam, wherein the motor is capable of rotating the drive spool;

a belt attached to the drive spool and disposed laterally within the channel, said belt capable of extending at least partially around the chest of a patient, wherein rotation of the drive spool tightens the belt to compress the chest of the patient;

a spline attached to the belt; and a slot disposed in the drive spool along the length of the drive spool, said slot sized and dimensioned to closely match the size and dimensions of the spline, wherein the belt is attached to the drive spool when the spline is disposed in the slot.

2. The chest compression device of claim 1 further comprising:

a guide plate;

wherein the guide plate is operably attached to a component of the chest compression device selected from the group consisting of the drive spool, the channel beam or both the drive spool and the channel beam;

wherein the guide plate is further disposed such that the guide plate secures the spline within the drive spool slot when the spline is inserted into the drive spool slot.

3. An electromechanical chest compression device comprising:

a housing for supporting a patient's back;

a motor disposed in the housing below the patient when the patient is supported by the housing;

a channel beam mounted to the housing, said channel beam laterally oriented with respect to the patient and defining a channel that extends laterally across the width of the housing;

a drive spool spanning the channel beam, said drive spool operably attached to the motor and rotatably attached to the channel beam, wherein the motor is capable of rotating the drive spool;

a belt attached to the drive spool and disposed laterally within the channel, said belt capable of extending at least partially around the chest of a patient, wherein rotation of the drive spool tightens the belt to compress the chest of the patient; and a first spindle rotatably attached to a first end of the channel beam and a second spindle rotatably attached to a second end of the channel, said second spindle disposed opposite the first spindle.

4. The chest compression device of claim 3 wherein the distance between the first spindle and the second spindle is in the range of about 12 inches to about 22 inches.

5. The chest compression device of claim 3 wherein the first spindle and the second spindle are inset a distance from the edges of the housing.

6. An electro-mechanical chest compression device comprising:

a housing for supporting a patient's back;

a motor disposed in the housing below the patient when the patient is supported by the housing;

a channel beam mounted to the housing, said channel beam laterally oriented with respect to the patient and defining a channel that extends laterally across the width of the housing;

a drive spool spanning the channel beam, said drive spool operably attached to the motor and rotatably attached to the channel beam, wherein the motor is capable of rotating the drive spool;

a belt attached to the drive spool and disposed laterally within the channel, said belt capable of extending at least partially around the chest of a patient, wherein rotation of the drive spool tightens the belt to compress the chest of the patient;

a detent operably connected to a component of the chest compression device selected from the group consisting of the drive spool and the channel beam; and wherein the detent is disposed such that the spool shaft is prohibited from rotating when the chest compression device is not in use.

7. The chest compression device of claim 6 further comprising:

a spline attached to the belt;

a slot disposed in the drive spool along the length of the drive spool, said slot sized and dimensioned to closely match the size and dimensions of the spline, wherein the belt is attached to the drive spool when the spline is disposed in the slot;

wherein when the spline is inserted into the drive spool slot the detent is displaced such that the spool shaft is allowed to rotate.

* * * * *